US006216625B1

(12) United States Patent
Baluha

(10) Patent No.: US 6,216,625 B1
(45) Date of Patent: Apr. 17, 2001

(54) SELF ADJUSTING TIDAL MOORING DEVICE

(76) Inventor: Mark Regan Baluha, 5690 Hackett Rd., Saginaw, MI (US) 48603

( * ) Notice: Subject to any disclaimer, the term of this patent is extended or adjusted under 35 U.S.C. 154(b) by 0 days.

(21) Appl. No.: 09/524,146

(22) Filed: Mar. 10, 2000

(51) Int. Cl.[7] ..... B63B 21/00
(52) U.S. Cl. ..... 114/230.27
(58) Field of Search ..... 114/230.1, 230.2, 114/230.26, 230.27, 230.29

(56) References Cited

U.S. PATENT DOCUMENTS 4,480,576 * 11/1984 Mills ..... 114/230.27
5,341,757 * 8/1994 Digiacomo ..... 114/230.27

* cited by examiner

*Primary Examiner*—Jesus D. Sotelo

(57) ABSTRACT

An improved self adjusting tidal mooring device for all typical mooring poles or pilings (38), mounted by conventional lag screws or bolts (24) by the stand off stainless steel mounting plates (26), which are fixed to both distal ends of the stainless steel vertical slide shaft (36) that is captivated by the UHWM polyethylene vertical slide block (40). The device uses conventional ropes or lines (50) attached at one one to the vertical slide block (40), by the machine line or rope slots (42), and at the other to the watercraft's conventional rope cleat (52). As tidal motions or water levels (W) act on the vessel (V) the vertical slide block is allowed to freely move up and down on the vertical slide shaft, while maintaining spacial position of the craft in the mooring slip.

9 Claims, 5 Drawing Sheets

FIG. 3
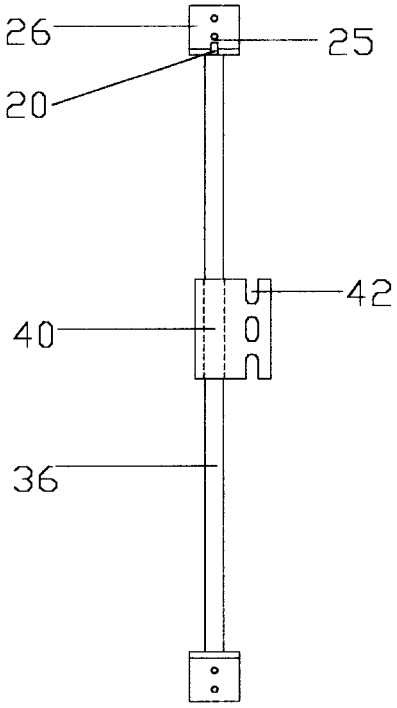
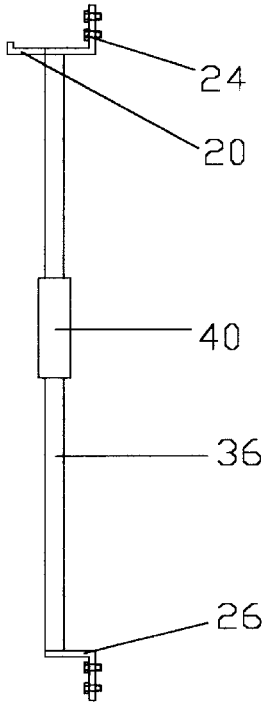
FIG. 4

SELF ADJUSTING TIDAL MOORING DEVICE

CROSS REFERENCE

Warwick U.S. Pat. No. 4,067,283
Culp U.S. Pat. No. 5,138,965
Daskalides U.S. Pat. No. 5,301,628
Cotton U.S. Pat. No. 5,361,716
Jones et al U.S. Pat. No. 5,408,946
Cotton U.S. Pat. No. 5,425,324
Wright et al U.S. Pat. No. 5,493,991
Shackleford,Jr U.S. Pat. No. 5,603,280
VanAsshe et al U.S. Pat. No. 6,000,356

BACKGROUND

1. Field of Invention

This invention relates to the design and application of an improved self adjusting tidal mooring device and more specifically to the ability of the device to self adjust and compensate for the raising and lowering of general bodies of water in relation to the moored or docked watercraft.

2. Description of Prior Art

A multitude of ways are known in which watercraft are secured to their respective mooring platforms or docks in the attempt to compensate for tidal actions of specific bodies of water. Whether moored in true tidal areas such as the ocean, sea or tributaries or docked in waters that exhibit tidal actions dictated by wind and weather, such as rivers and lakes, there are many different methods and a few specific devices that attempt to absorb or compensate for this mass movement of water. One of the most prevalent actions taken in the attempt to compensate for tidal action is specific positioning of ropes or lines that secure the watercraft to the mooring platform. Those skilled in the art are familiar with the methods of how lines or ropes are positioned from dock to craft and crisscrossed from port to starboard or side to side and for and aft or front to back of the watercraft. This crisscross positioning of lines from dock to craft and vice versa allows the watercraft to raise and lower in relation to the stationary mooring platform and the tidal action of the water inside the criss-crossed lines. There are many problems associated with this method, one is the small slip or dock space wherein the craft has very little room to move forward and back or side to side. The lines have to be relatively tightly tied and in large tidal movement, the craft can actually run out of rope length and be either suspended or held down as the water rises. Also, multiple ropes crisscrossed for and aft and side to side create a web of ropes which can be confusing and dangerous for the crew or handlers in bad weather or extreme tidal movement. Alternatively, the use of numbers of ropes to compensate for tidal movement relies on the lines or ropes having slack or loose length, this slack line can actually lead to the craft springing against the ropes, generating momentum, back and forth as wind and waves drive the vessel against the lengths of these ropes. This motion is exacerbated by the very lines designed to compensate for craft movement. Tremendous force is exerted against the mooring points on the boat and dock as the craft springs back and forth. The improved self adjusting tidal mooring device eliminates slack lines thus reducing the forces that can be exerted on the tie up points and the lines themselves by elimination of this energy or momentum, produced by the spring of the lines.

The improved self adjusting tidal mooring device allows the watercraft to be securely tied to the mooring platform to lessen the chance of accidental contact with the dock.

Another action or device is the use of a mooring whip, which is typically a flexible pole, shaft or spring that is attached at one end of the dock or mooring platform and the other end is bent down and secured to the watercraft's cleat or tie down. The pole or spring bends, up or down, to compensate for tidal movement. This device is more specifically designed to hold the watercraft away from the dock or mooring platform. This method requires that the user bend the unit to the craft, this creates a potential serious problem in the accidental release of the whip, which will very quickly release it's own stored energy. The mooring whip, as well as, ropes or lines themselves leave the watercraft vulnerable to waves, wakes, and unusually high or low tidal events. Whips and, springs particularly, are vulnerable because of their very nature. Cotton in U.S. Pat. Nos. 5,361,716 and 5,425,324 shows us such typical spring type tensioners and the dangers of such devices are immediately evident. These units not only store potential dangerous energy but also require custom placement in relation to the vessel to be moored. The actions of wind and waves are much greater than the force of bend that one person could ever possibly exert to fasten the craft and resist potential tidal movement from forcing the vessel into the dock.

Many more elaborate sliding mechanisms from clamps to spring loaded cable devices, have been tried with greater and lesser degrees of success to compensate for tidal action. One thing remains constant and true, the strength and power of wind and water. Most known methods have been adequate at best even in normal, calm conditions. Clamping devices or devices that are tightly or physically attached to the boat or watercraft, such as those shown by Warwick in U.S. Pat. No. 4,067,283, Culp in U.S. Pat. No. 5,138,965, Jones in U.S. Pat. No. 5,408,946, and Wright in U.S. Pat. No. 5,493,991 have exhibited the same design flaws. The units provide vertical movement, but, so close to the mooring point that wind and/or waves cause the units to move up vertically and the watercraft can move in under the slide or up into the slide or pole creating potentially serious damage and at best, only cosmetic damage. Once again, the user must implement multiple methods to prevent potential harm. For example, the use of fenders or other methods to keep the craft away from the mooring platform negates the claims of no harm by both Warwick, Culp and the others. Also, Warwick, Culp and others utilize slides, springs and/or pulleys with complicated means and methods to achieve their vertical movement claimed, these components because of their own design, inherently require maintenance and, if, maintenance is not routinely carried out, potential failure would be imminent. The improved self adjusting tidal mooring device requires no maintenance and is self cleaning. The main flaw of most of these designs is their overall production costs prohibit their use as commercially viable methods. Not to mention the fact that cleaning the key components requires that the unit be completely disassembled. The improved self adjusting tidal mooring device provides simple and efficient means of vertical movement. Combine this with corrosion resistant materials and design of the exterior sliding mooring block to provide the boater with a mooring device that will stand up to the extreme environments of wind, water and waves. Many of the methods known are bulky and quite complicated, not to mention, not very aesthetically appealing. VanAsshe shows us in U.S. Pat. No. 6,000,356 one such quite complicated device, that requires many specific and exact locations of the shown device. This is not only known in VanAsshe's device but Culp and almost all of the others make this requirement also. Therefore, the device not only demands specific mounting points but requires modification of the craft itself This makes these devices specific not only to location but individual watercraft. The improved self adjusting tidal mooring device is very easily located and does not require any modification of the vessel in any way.

Daskalides in U.S. Pat. No. 5,301,628 and Shackelford,Jr. in U.S. Pat. No. 5,603,280 show us less complicated slide mechanisms that are less position specific but utilize typical square or rectangular slide design, which, is known to those skilled in the art, to present potential binding and seizing, by inherent design. Minor damage to the slide itself will advent in system failure. Also, all of the vertically sliding shown apparatus use internal sliding components more susceptible to binding and corrosion, inherent in the applications and enviroments these devices are intended.

The self adjusting tidal mooring device is located on the side of the dock or platform piling, not on the face of the pole as shown by many such as Warwick, Culp and others. This provides many advantages such as the use of the improved self adjusting tidal mooring device to be used in tight slips. Larger boats can use slips not ordinarily used because of the low profile of the device located out of the way, on the side of the pole not on the face or inside of the slip itself. The improved self adjusting tidal mooring device allows ropes and lines to be snugly tied with minimal slack line, substantially reducing roll and line shock generated by wind and waves. The vessel is allowed to ride the wave or wake and because of the snug lines reduces stress on, not only the craft's cleats but the mounting points of the device itself. One of the most unique points of the device is the simplicity of the design that actually provides greater tidal movement than the device's total length. As the vessel rises or lowers with tide or wave and reaches the top or bottom of the device's vertical limits, the lines or ropes provide the geometric equivalent of the long leg of a triangle. This design provides for tidal movement of five to six feet or more from a device length of 3 to 4 feet. Depending on the line or rope length, vertical travel can be more. The device's ability to stabilize wave and wake shock, by the slide design and the device's own weight, along with the short lengths of ropes or lines required to snugly tie the vessel, assures that the craft will stay right where the handler positions it in relation to the dock itself Also, exact position of the craft can be easily and efficiently changed. Major advantages of the device are that well known methods of handling the vessel and dock lines are still used and made more efficient. For example, fewer numbers of lines are required to secure the vessel position in the mooring slip. The mooring block on the device moves vertically absorbing wave and wake, thus reducing line stress on the mooring points on the vessel.

The mooring block also moves rotationally, up to 270 degrees or more, providing use by all craft, large or small, by the same unit in the same mooring space.

The improved self adjusting tidal mooring device's greatest strength is exhibited at the ends of the device's limits, where it is most needed in acute tidal movement or adverse weather.

GENERAL NATURE OF THE INVENTION

An improved self adjusting tidal mooring device is proposed which incorporates one structure that mounts to all well known structures and has a round primary slide shaft over which the vertically movable mooring block is positioned. The round slide shaft is captivated by the mooring block on all sides by a round hole slightly larger than the slide shaft through the vertical length of the block. The vertical slide shaft stands off or away from the piling or pole, by the mounting brackets, to allow the mooring block to slide up and down vertically, and also, spin rotationally on the axis of the vertical side. This provides longitudinal line location for different craft or tie up in different positions in the slip itself The mooring block is shaped to provide easy line or rope attachment or removal by means of a horizontal hole parallel, but separate from, the vertical slide hole in the back side of the block. Slots, above and below the horizontal line hole, of similar size, are located in the top and bottom front sides of the block. Typically, the looped end of the rope is passed through the horizontal line hole and the loop is opened back over the block and slid into the slots at the top and bottom of the block.

As the other end of the rope is pulled tight the looped end closes around the slots in the block, captivating the rope on the block. The block is free to move up or down on the round vertical slide shaft which is attached by conventional means to the side of the dock pole or piling, parallel to the dock surface or the watercraft. Typically the device is used in pairs on both sides of the vessel, for and aft, or two on the front end and two on the back end of the craft. The device is attached to the dock poles irregardless of location of the vessel in the mooring slip.

OBJECTS AND ADVANTAGES

Accordingly, besides the objects and advantages of the improved self adjusting tidal mooring device described in the above patent, several objects and advantages are:

(a) To provide an improved self adjusting tidal mooring device that uses conventional methods of attachment to promote ease of use;

(b) To provide an improved self adjusting tidal mooring device that is unobtrusive in the mooring environment;

(c) To provide an improved self adjusting tidal mooring device that incorporates a round slide mechanism that the tidal mooring block slides over;

(d) To provide an improved self adjusting tidal mooring device that has a minimum number of moving parts to reduce mechanism failure or break down;

(e) To provide an improved self adjusting tidal mooring device that is easy to use and maintain.

Further objects and advantages will become apparent from a consideration of the ensuing description and drawings.

DRAWING FIGURES

FIG. 1 shows an end view from the back of a watercraft securely positioned in the mooring slip at low tide and approaching the lower limit of the self adjusting tidal mooring device.

The weight of the vertical slide blocks helps reduce slack lines, shown at a shallow angle, one can see that this angle will allow the vessel to travel past the physical limit of the device itself.

FIG. 3 shows an end view of the improved self adjusting tidal mooring device and the mounting points on either distal end, the vertical slide block and the machined rope slots in the block.

FIG. 4 shows a side view of the device with the mounting plates on either distal end and the slide block in the approximate center of the slide, the typical conventional lag screw position in the mounting plates, and how the device's mounting feet or pads hold the vertical slide away from the piling or pole that the self adjusting tidal mooring device is mounted. Also shown is the rope stowage hook or bar that provides for easy line stowage while not in use.

Figure 5:
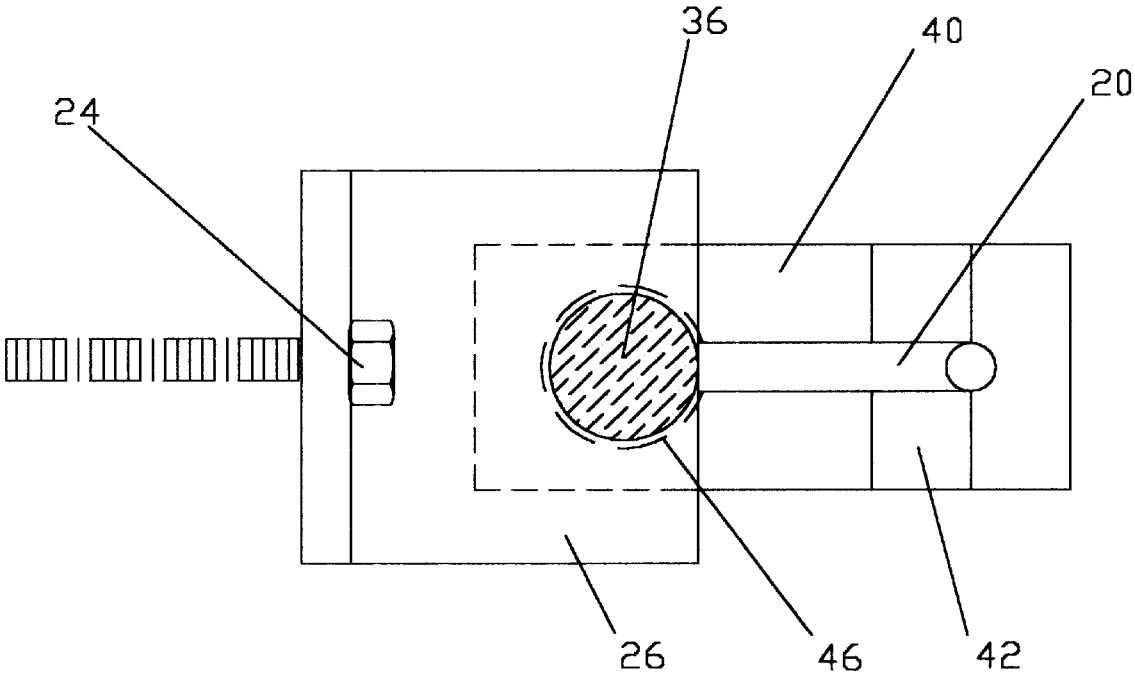

FIG. 5 shows a top view of the self adjusting tidal mooring device and the lag screw and mounting plate, the vertical slide block is shown captivating the vertical slide and the top machined rope slot, and the top view shows how the slide block can move rotationally on the vertical slide for up to 270 degrees of rotational movement. A top view of the rope stowage hook is also seen.

Figure 6:
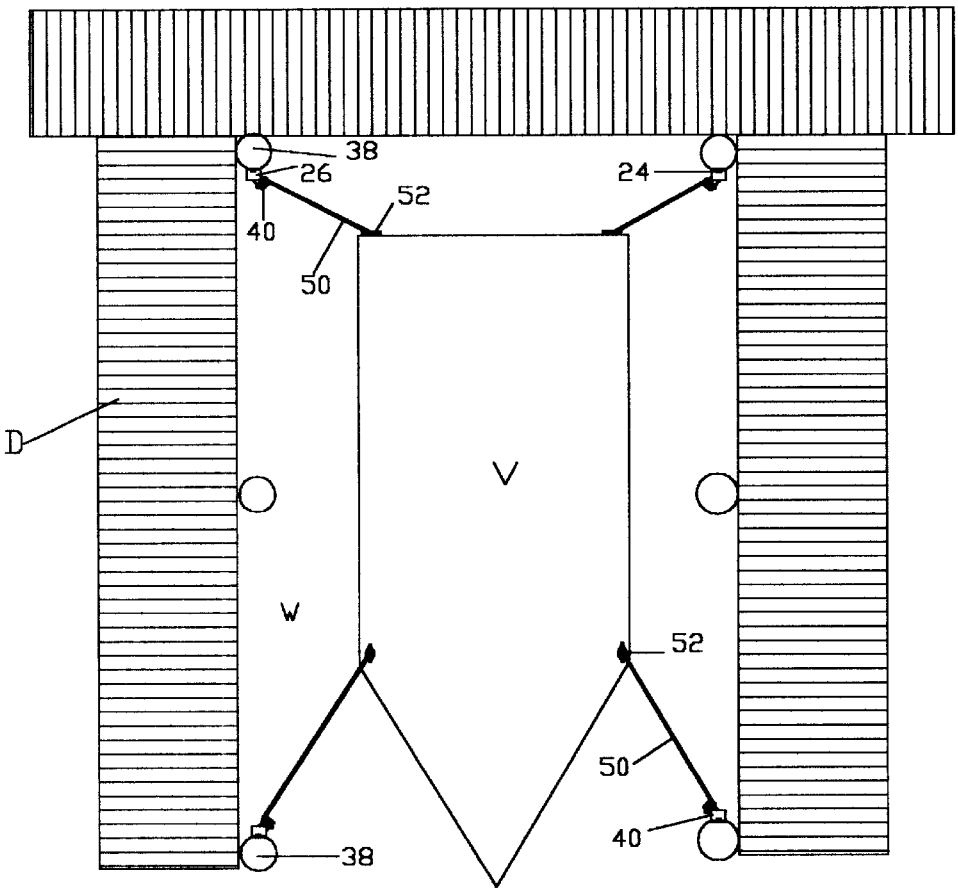

FIG. 6 shows a top view of a typical mooring arrangement at the sides of the watercraft, how the tidal mooring devices are mounted in non-obstructing position on the sides of the pilings and with the snug lines, one can see that the vessel can move up and down but not side to side or back and forth. This figure also shows that the device does not require specific location in relation to the watercraft. Longer lines actually promote greater tidal range for the vessel.

REFERENCE NUMERALS IN DRAWINGS

D dock or mooring platform
V watercraft or vessel
W water level
20 rope or line stowage hook
24 conventional stainless steel lag bolt
25 drilled holes in the mounting plate for conventional lag bolt
26 stand off stainless steel mounting plates
36 stainless steel vertical slide shaft
38 dock pole or piling
40 UHMW polyethylene vertical slide block
42 machined line or rope slots in vertical slide block
46 machined hole in vertical slide block used to captivate vertical slide
50 conventional lines or rope used to secure watercraft
52 conventional rope or line cleat fixed to watercraft

DESCRIPTION—FIGS. 1 TO 6

Figure 1:
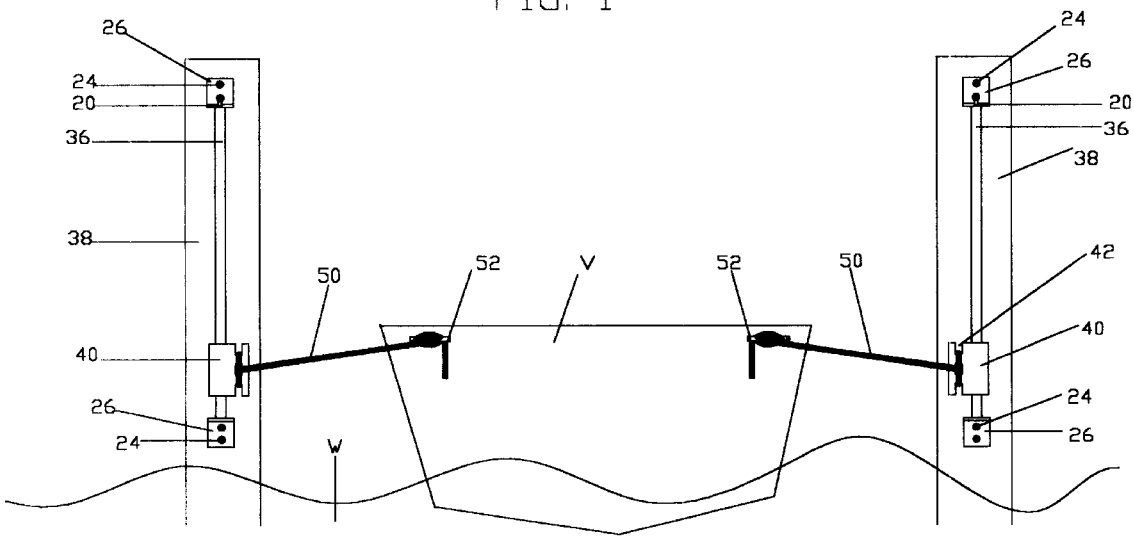

Referring more specifically to the drawings, FIG. 1 illustrates the end back view. A typical view of one end application of the improved self adjusting tidal mooring units of the present invention—commonly referred to as the "device".

Figure 2:
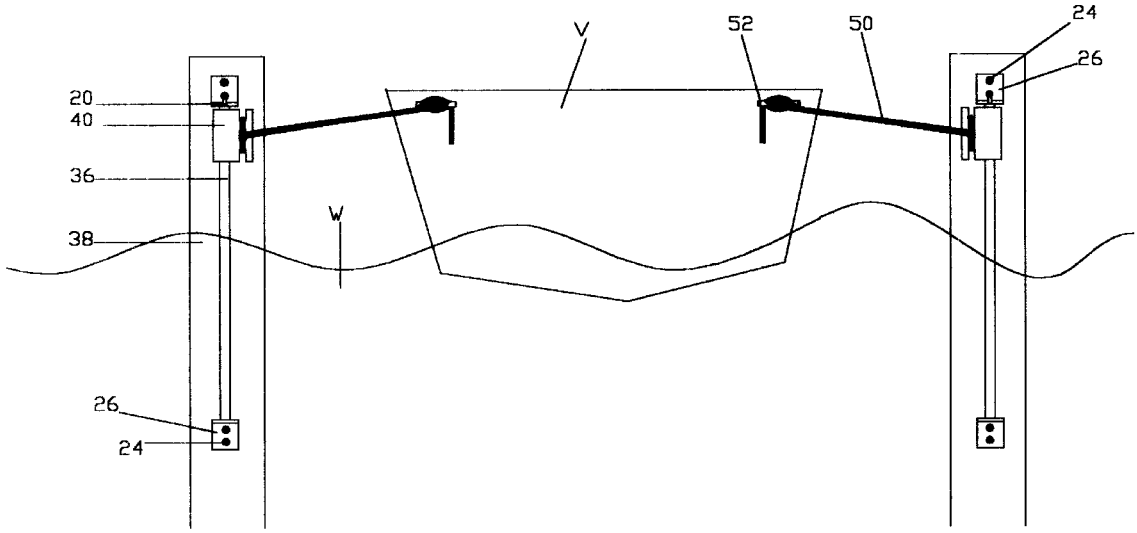
FIG. 2 shows an end view from the back of a watercraft securely positioned in the mooring slip and at high tide and approaching the higher limit of the self adjusting tidal mooring device. One can see that as the vessel is moved by wind or waves that the slides allow the vessel to easily "ride" them without jerking against stationary mooring points.

In use, typically, FIG. 1 and FIG. 2, the device utilizes an ultra high molecular weight (UHMW) polyethylene vertical slide block (40), typically, between 2–3 inches wide and 68 inches long and which can be machined by conventional means with a round hole, usually, 1.625 inches in diameter, machined through the length. This 1.625 inch hole captivates the stainless steel, typically 316 grade for greatest corrosion resistance, vertical slide shaft (36) that is 1.5 inches in diameter and of a length, typically, 48 inches long. Stand off, ½ inch thick, 4 inch wide by 4 inch high, stainless steel mounting plates (26) are welded on each end of the vertical slide shaft (36) and the device is mounted, in vertical length, through conventionally machined holes (25) by standard ½ inch stainless steel bolts or screws (24) to the side of the dock pole or piling (38).

The UHMW vertical slide block (40) has conventionally machined rope slots (42) to secure one end of the rope (50) to the vertical slide block (40) and the other end of the rope (50) to the watercraft's fixed cleats (52). The weight of the vertical slide block (40) keeps tension on the ropes (50). As the water level (W) rises and lowers the vertical slide blocks (40) move up and down the vertical slide shaft (36) allowing the watercraft (V) to move vertically in the mooring slip but still remain securely positioned in relation to the dock ()).

FIG. 3 and FIG. 4 show the devices typical shape and length with the UHMW vertical slide block (40) positioned on the vertical slide shaft (36). The inch wide by one and one half to two inch machined rope slots (42) are shown, as well as the stand off ½ inch thick mounting plates (26) and the conventional fasteners (24).

FIG. 5 shows the top view of the typical construction of the device. The UHMW vertical slide block (40) is shown with a top view of the rope slot (42), the slightly larger, block bore (46) of 1.625 inches and the 1.5 inch, captivated, stainless steel vertical shaft (36). The stand off, ½ inch by 4 inch mounting plate (26) and the conventional ½ inch fastener (24) is also shown.

FIG. 6 shows a typical embodiment of how the device is mounted on the sides of the pilings (38) using conventional fasteners (24) and a typical view of the vessel (V) positioned in the mooring slip in relation to the dock (D).

SUMMARY, RAMIFICATIONS, AND SCOPE

Briefly, the present invention comprises an improved self adjusting tidal mooring device for use in securing watercraft to stationary mooring platforms using an UHMW vertical slide block with a bore to captivate a stainless steel, vertical, round shaft, mounted to the side of the pole or piling. A rope is secured to the vertical slide block via machined rope slots and can be stored on the provided rope hook at the top mounting plate. When the device is used, the rope that is secured to the vertical slide block is pulled snug and attached by conventional means to the fixed cleats on the watercraft on three or four comers of the vessel. As tide, waves, or wake occur the craft can move up and down vertically on the vertical slide shafts via the slide blocks and the blocks themselves can be positioned rotationally to compensate for vessel characteristics.

In a preferred embodiment, the vertical slide blocks are manufactured of a strong, wear resistant, and self-lubricating material such as ultra high molecular weight polyethylene or other well known materials, and the vertical captivated slide shaft and mounting hardware is manufactured of strong, corrosion resistant materials such as 316 stainless steel. The improved self adjusting tidal mooring devices are typically used in pairs, on either a side or end and work to create balanced tidal movement of the watercraft and reduce shock and stress on the mooring points of the vessel and the dock.

Although the description above contains many specificity's, these should not be construed as limiting the scope of the invention but as merely providing illustrations of some of the preferred embodiments of the invention. For example, the slide blocks can be of another shape or material. The slide shafts can be longer or shorter or made of another material. Also, size, shape and length can be modified. Thus the scope of the invention should be determined by the appended claims and their legal equivalents rather than by the examples given.

I claim:

1. In an improved mooring device, a rigid elongate device acting as a self adjusting tidal mooring device comprising:

(a) an elongate vertical shaft having a top end and a bottom end, captivated by a vertical slide block, which has a top, a bottom, one side with a through bore to captivate said vertical shaft and one side machined to accept a mooring rope;

(b) a vertical slide block made of an elastomeric material such as polyethylene;

(c) said vertical slide block having no moving parts;

(d) mounting brackets at each vertical end of said shaft wherein said device stands away from a dock pole allowing said vertical slide block and shaft to operate independently of a mooring platform;

(e) wherein said mooring device limits line tension on a watercraft and mooring point while maintaining spatial position of the watercraft in a mooring slip, while allowing the watercraft to move vertically with wind, waves, and water.

2. An improved self adjusting tidal mooring device as in claim 1, wherein said device is mounted on the side of a dock pole, parallel to the watercraft, and completely out of the viable mooring area of a dock; whereby said side mounting provides mooring line and watercraft movement without said watercraft ever being able to contact any part of said device and eliminating the said device being an obstruction in a mooring area.

3. An improved self adjusting tidal mooring device as in claim 1, wherein the elastomeric vertical slide block is self cleaning and self lubricating.

4. An improved self adjusting tidal mooring device as in claim 1, wherein a hook is attached to one end of said vertical shaft for a mooring line to be hung while not in use.

5. An improved self adjusting tidal mooring device as in claim 1, wherein said device is adjustable enough to be used in conjunction with a floating dock to equalize line strain and pressures on a watercraft.

6. An improved self adjusting tidal mooring device as in claim 1, wherein said device can be used opposite a floating dock.

7. An improved self adjusting tidal mooring device as in claim 1 wherein said device vertical slide block is machined to accept specific attachments, such as an interlocking channel, for mooring collection devices, such as, oil booms, sensors, or platforms.

8. An improved self adjusting tidal mooring device as in claim 1, wherein said device vertical slide block is buoyant.

9. An improved self adjusting tidal mooring device as in claim 1, wherein said device vertical shaft can be configured as one of a square, triangle, or hexagon.

* * * * *